United States Patent [19]

Ito

[11] Patent Number: 4,524,712

[45] Date of Patent: Jun. 25, 1985

[54] VARNISH COATER FOR PRINTED PRODUCT

[75] Inventor: Kiyoshi Ito, Chiba, Japan

[73] Assignee: Komori Printing Machinery Co., Ltd., Tokyo, Japan

[21] Appl. No.: 576,219

[22] Filed: Feb. 2, 1984

[30] Foreign Application Priority Data

Feb. 3, 1983 [JP] Japan ..... 58-16602

[51] Int. Cl.[3] ..... B05C 1/02

[52] U.S. Cl. ..... 118/46; 118/249; 118/236; 118/262; 101/352

[58] Field of Search ..... 118/46, 203, 262, 696, 118/699, 704, 249, 236; 101/350, 351, 352, 416 B

[56] References Cited

U.S. PATENT DOCUMENTS 2,788,742 4/1957 French ..... 101/351

4,130,057 12/1978 List et al. ..... 101/352 X

OTHER PUBLICATIONS

"Nonflammable Aqueous Overcoatings Serve to Speed Ink Drying, Add Gloss to Printed Sheet", G. J. Lindner, *Graphic Arts Monthly*, pp. 66–69, Oct. 1977.

*Primary Examiner*—John P. McIntosh

*Attorney, Agent, or Firm*—Blakely, Sokoloff Taylor & Zafman

[57] ABSTRACT

In a varnish coater for a printed product, a blanket cylinder and a form roller are respectively supported by eccentric bearings to throw on/off the blanket cylinder with respect to the form roller and an impression cylinder and throw on/off the form roller with respect to the blanket cylinder, and rollers provided in the eccentric bearings of the form roller are brought by biasing means into tight contact with the cam surfaces of cams pivoted by pivot means so as to simplify adjustment of a contact pressure of the form roller with respect to the blanket cylinder at the throw-on and -off positions of the blanket cylinder.

5 Claims, 6 Drawing Figures

VARNISH COATER FOR PRINTED PRODUCT

BACKGROUND OF THE INVENTION

The present invention relates to a varnish coater disposed between a printing unit and a delivery apparatus of a rotary press or in an independent coating unit to apply varnish on a printed surface.

The surface of paper printed by a rotary printing press is not quickly dried and can be contaminated in the subsequent processing. In a sheet-fed rotary printing press, offsetting tends to be caused when printed sheets are stacked. In order to solve these problems, conventionally, a dryer is arranged in a delivery path of the printed products, or a powder is sprayed on the printed paper surfaces. However, in this case, the dryer becomes large, and powder spraying results in surface roughening of the printed surface. Surface roughening tends to entail a loss of gloss and subsequent poor printing. Instead of these techniques, varnish is applied to the printed surface to prevent the surface from being contaminated and to give it gloss. Varnishing is performed in printed products such as covers of books, catalogs and pamphlets which require an aesthetic effect.

The varnish coater is used as an independent apparatus. However, recently, the varnish coater is generally disposed in a delivery path of a printing press to shorten a coating time and an associated operation time for restacking the printed sheets and hence to improve the coating efficiency. The varnish coater generally has rollers in the same manner as that of a dampening apparatus for dampening a surface of a plate mounted on a plate cylinder of the printing unit. Varnish stored in a varnish pan is supplied to a surface of a blanket cylinder through the rollers. The varnish is transferred to a sheet passing between the blanket cylinder and an impression cylinder.

However, the conventional varnish coater of this thick paper such as a cover. The blanket on the surface of the blanket cylinder is partially deformed to result in a nonuniform thickness of the varnish film. In this case, a thickness of an underlay inserted between the blanket and the metal surface of the blanket cylinder must be adjusted after the rotary printing press is stopped. When the rollers are stopped for a long period of time while the coating operation is interrupted, varnish is hardened and many wasted paper sheets are produced when the coating operation is restarted. In order to prevent this, the rollers inserted between the form roller and the varnish type has the following problem in contact pressure adjustment between the blanket cylinder and the form roller for transferring varnish to the blanket cylinder. During the coating operation, since the blanket cylinder is in sliding contact with the form roller which transfers varnish to the blanket cylinder, the contact pressure of the form roller with respect to the blanket cylinder must be properly adjusted to obtain a uniform thickness of the varnish film to be coated on the printed sheet. On the other hand, the coating operation is often performed for pan must be brought into sliding contact with the form roller. After the blanket cylinder is washed or cleaned, the underlay is adjusted. Subsequently, after the underlay is adjusted, the blanket cylinder is located in the throw-on position. In this case, in order to properly perform the coating operation, the form roller must be brought into tight contact with the blanket cylinder to transfer varnish from the form roller to the blanket cylinder before the blanket cylinder is located in the throw-on position. The adjusting condition is preferably checked. For this purpose, the contact pressure of the form roller with respect to the blanket cylinder must be properly adjusted even if the blanket cylinder is located in the throw-off position.

In this manner, the contact pressure of the form roller with respect to the blanket cylinder must be controlled for both the throw-on and throw-off positions of the blanket cylinder. Conventionally, the contact pressure is adjusted by a turnbuckle and an eccentric pin, or by stoppers for defining the pivotal range of the form roller support arm. In addition, the contact pressure adjustments are independently performed at the throw-on and throw-off times of the blanket cylinder. The contact pressure adjustment must be performed every time irregular thickness is eliminated or the blanket of the blanket cylinder is worn out, resulting in time-consuming operation. In addition to this disadvantage, since an impact occurs when the form roller is brought into tight contact with the blanket cylinder by means of the form roller arm, the durability of the component parts is degraded upon repetition of the above contact operation. Furthermore, when the contact pressure is adjusted at the throw-on and -off positions, the pressure adjusted at one of the positions influences that at the other, resulting in inconvenience.

SUMMARY OF THE INVENTION

It is an object of the present invention to provide a varnish coater capable of simplifying adjustment of a contact pressure of a form roller with respect to a blanket cylinder at the throw-on and -off positions of the blanket cylinder.

It is another object of the present invention to provide a varnish coater capable of smoothly contacting the form roller with the blanket cylinder and improving the durability of the coater.

In order to achieve the above and other objects, the blanket cylinder and the form roller are respectively supported by eccentric bearings to throw on/off the blanket cylinder with respect to the form roller and an impression cylinder and throw on/off the form roller with respect to the blanket cylinder, and rollers provided in the eccentric bearings of the form roller are brought by biasing means into tight contact with cam surfaces of cams pivoted by pivot means.

According to the present invention, there is provided a varnish coater for coating varnish transferred from a form roller to a blanket cylinder on a printed sheet passing through the blanket cylinder and an impression cylinder, comprising:

first eccentric bearings for supporting the form roller;

rolling members mounted on outer end portions of the first eccentric bearings, respectively;

cams which are pivotally supported by second eccentric bearings, respectively, and each of which has a large diameter portion and a small diameter portion which are selectively brought into contact with a corresponding one of the rolling members;

first pivoting means for pivoting the cams;

biasing means for biasing the rolling members each of which is brought into tight contact with one of the large and small diameter portions of a corresponding one of the cams; and second pivoting means for pivoting the second eccentric bearings to shift an axis of a cam shaft of the cams.

DESCRIPTION OF THE PREFERRED EMBODIMENT

Figure 1:
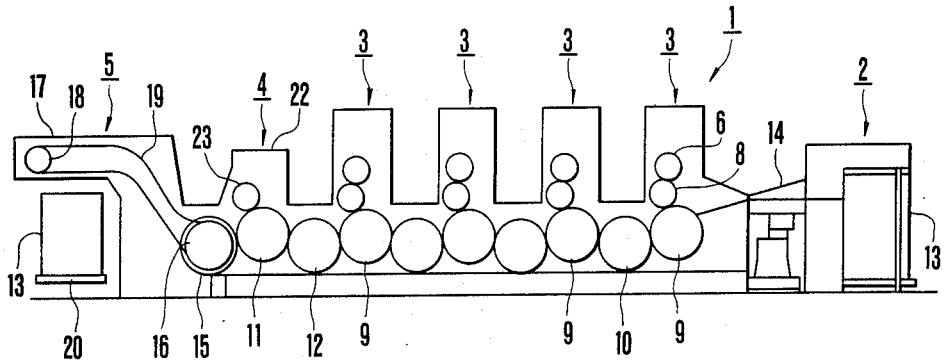
FIG. 1 is a schematic side view of a four-color sheet-fed offset rotary printing press.
Figure 2:
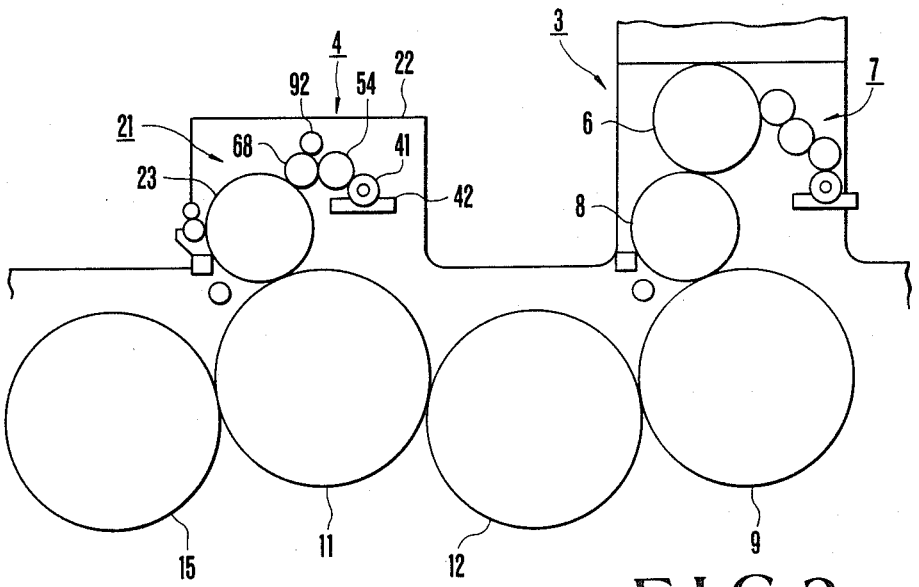
FIG. 2 is a schematic side view of a fourth color printing unit and a coating unit of the rotary printing press shown in FIG. 1.

Referring to FIGS. 1 and 2, a four-color sheet-fed offset rotary printing press 1 comprises a sheet feeder 2, four color printing units 3, a coating unit 4 and a delivery apparatus 5. These components are separately assembled and constitute the rotary printing press 1. Each printing unit 3 has a plate cylinder 6 having a printing plate thereon, an inking apparatus (not shown) for supplying a corresponding ink to the cylinder surface, and a dampening apparatus 7 for supplying dampening water to dampen the cylinder surface. A blanket cylinder 8 is brought into contact with each plate cylinder 6 on which an image is formed by utilizing the corresponding color ink and water. The image on the plate cylinder 6 is transferred to the blanket cylinder 8 upon relative rotation therebetween. In each printing unit 3, an impression cylinder 9 having a diameter twice that of the blanket cylinder 8 is brought into contact therewith. A transfer cylinder 10 having the same diameter as the impression cylinder 9 is sandwiched between adjacent impression cylinders 9 of the corresponding printing units 3. An impression cylinder 11 having a diameter twice that of a blanket cylinder 23 (having the same construction as the blanket cylinder 8) of the coating unit 4 is disposed to be in contact with the blanket cylinder 23 and at the same level as the other impression cylinders 9 of the printing units 3. A transfer cylinder 12 is sandwiched between the impression cylinder 9 of the fourth color printing unit 3 and the impression cylinder 11 of the coating unit 4. Paper sheets 13 stacked on the feed table of the sheet feeder 2 are taken up by a sheet pick-up device (not shown) and are fed one by one onto a feedboard 14. Each sheet 13 is gripped with grippers of the first color impression cylinder 9 by means of a swing gripper. The sheet 13 is printed by the blanket cylinders 8 with four colors while the sheet 13 is sequentially fed by the transfer cylinders 10 and the corresponding impression cylinders 9. The printed sheet is then gripped by grippers of the impression cylinder 11 and is wound therearound.

The delivery apparatus 5 comprises a delivery cylinder 15 which is brought into contact with the impression cylinder 11, and a pair of right and left sprockets 16 which are coaxially mounted on the delivery cylinder 15. Delivery chains 19 each having grippers at equal intervals are respectively looped between the right and left sprockets 16 and front end sprockets 18 of a delivery frame 17. The sheet 13 gripped by the grippers of the impression cylinder 11 is gripped by the grippers of the chains 19 and transferred thereby. The sheet 13 is released from the grippers of the chains onto a stack board 20.

The coating unit 4 having the construction described above has a varnish coater 21 to be described below.

Figure 3:
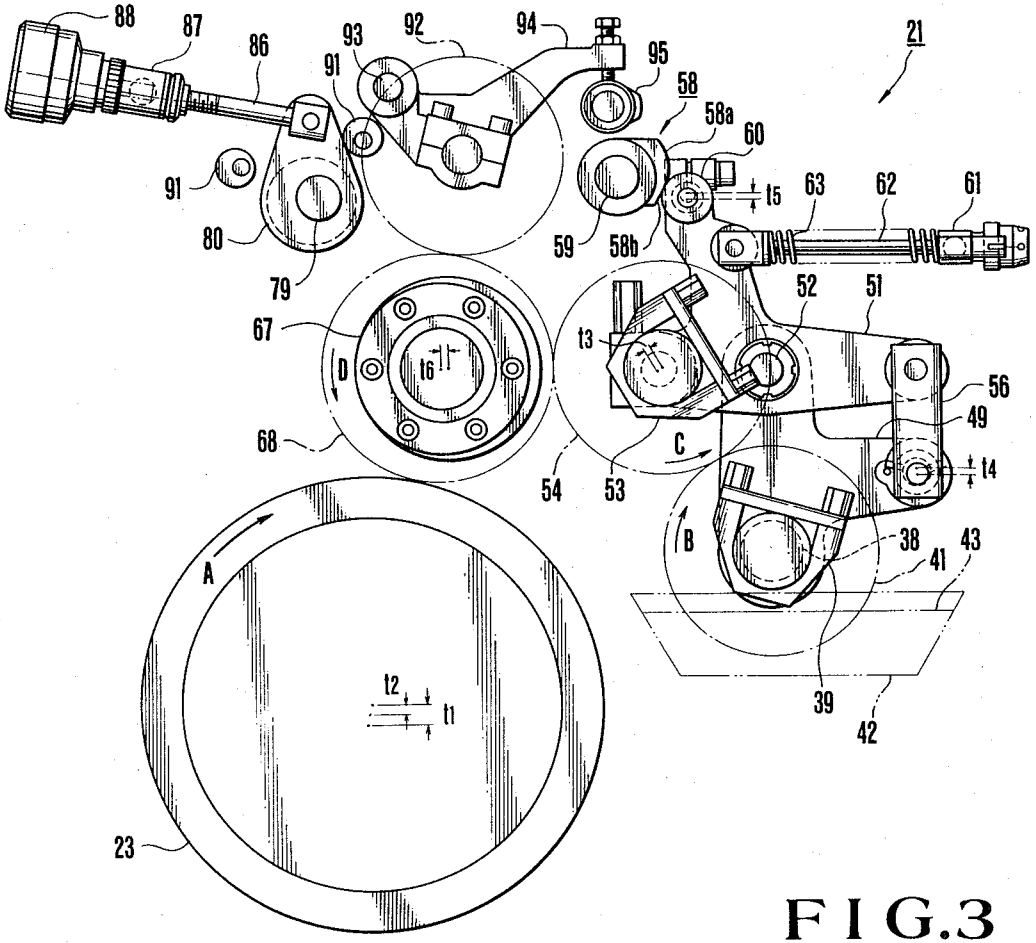
FIG. 3 is a side view of a varnish coater of the coating unit shown in FIG. 2 according to an embodiment of the present invention.
Figure 4:
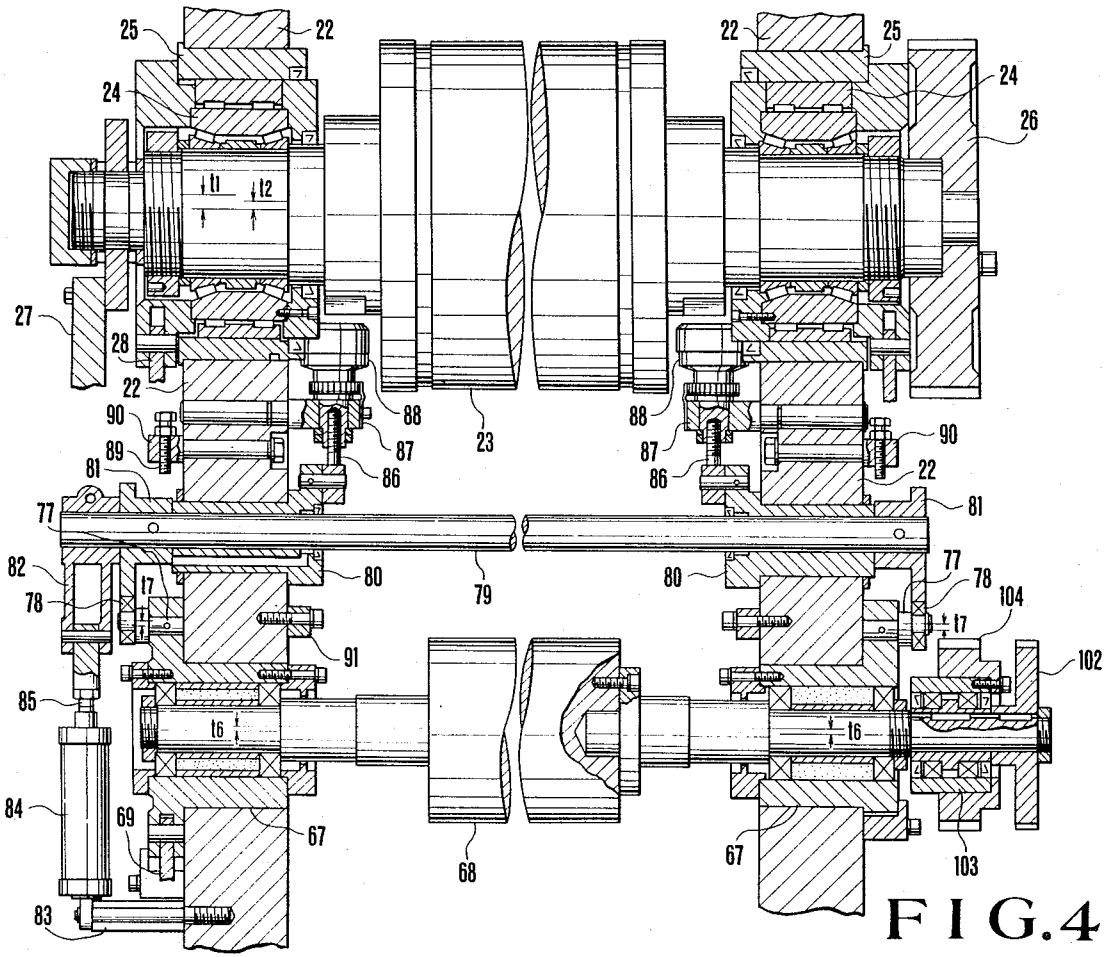
FIG. 4 is a developed sectional view of a portion including a blanket cylinder and a form roller of the varnish coater shown in FIG. 3.

Referring mainly to FIG. 4, the blanket cylinder 23 having the same diameter as that of the blanket cylinder 8 is rotatably supported by right and left frames 22, respectively, through pairs of antifriction bearings 24 and plain bearings 25. The blanket cylinder 23 is rotated in the direction indicated by arrow A (FIG. 3) upon rotation of a cylinder gear 26 coupled to a driving source. The axes of the bearings 24 and 25 are respectively deviated by distances t1 and t2 with respect to the axis of the blanket cylinder 23. A lever 27 pivotally mounted on the corresponding rolling bearing 24 of the frame 22 is reciprocated by means of an air cylinder to bring the blanket cylinder 23 into contact with or separate it from the impression cylinder 11. A lever 28 pivotally mounted on the plain bearing 25 is reciprocated by a handle to adjust the contact pressure between the blanket cylinder 23 and the impression cylinder 11.

Figure 5:
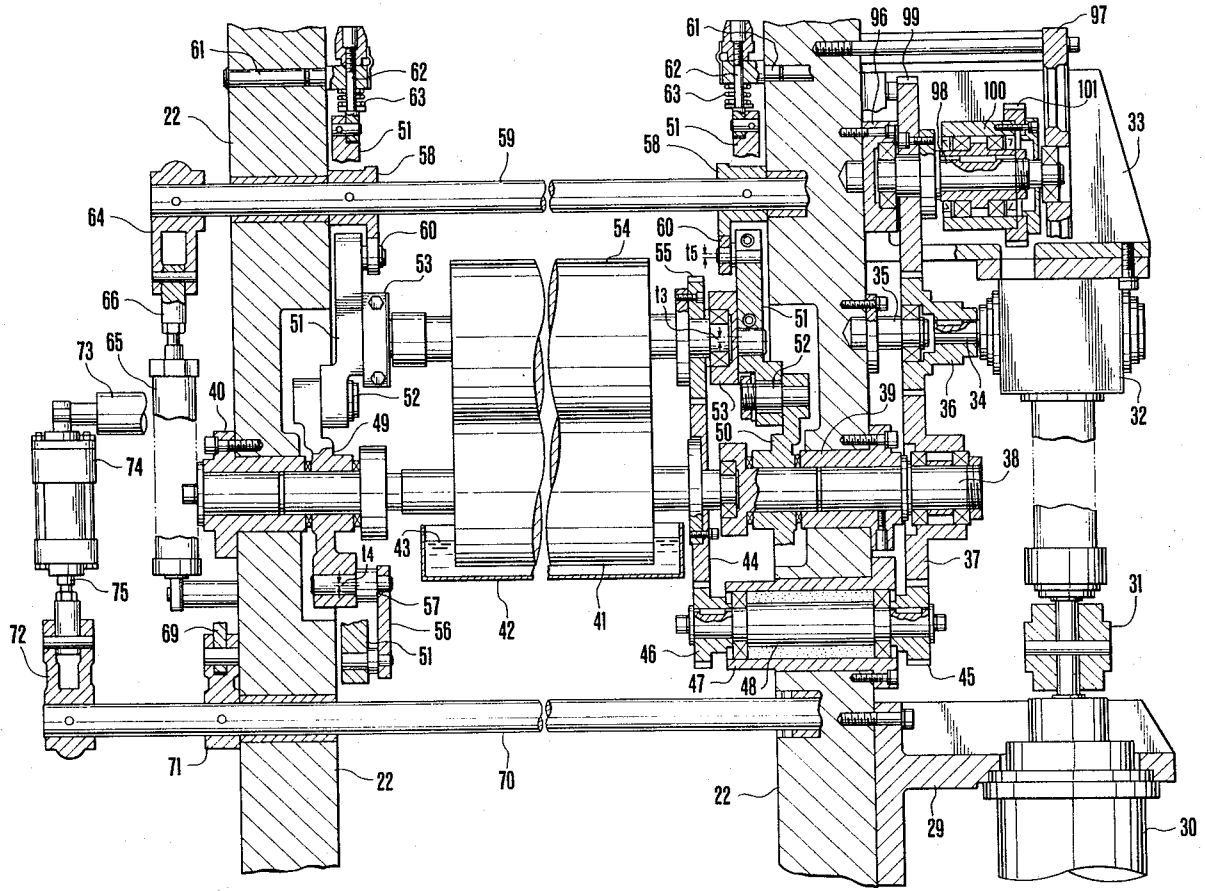
FIG. 5 is a developed sectional view of a portion including a pan roller and a metering roller of the varnish coater shown in FIG. 3.

Referring mainly to FIG. 5, a DC variable motor 30 is supported and mounted on a bracket 29 fixed on the outer surface of one of the frames 22. A gear box 32 coupled to the shaft of the motor 30 through a coupling 31 is supported and mounted on a bracket 33 fixed on the outer surface of this frame 22. A driving gear shaft 34 is coupled to the motor shaft through a bevel gear which is disposed in the gear box 32 to be perpendicular to the motor shaft. A driving gear 36 supported by a stud 35 which extends outward from the frame 22 is fixed on the driving gear shaft 34. A gear shaft 38 is supported on the frame 22 through a bearing 39 to rotatably support an intermediate gear 37 meshing with the driving gear 36. One end of a pan roller 41 is rotatably supported by the bearing portion of the gear shaft 38 extending inwardly of the frame 22. The other end of the pan roller 41 is supported by a bearing 40 of the opposing frame 22. The pan roller 41 is dipped in varnish 43 stored in a varnish pan 42. A pan roller gear 44 is fixed on a collar in the vicinity of the gear shaft 38. Reference numerals 45 and 46 denote gears which respectively mesh with the intermediate gear 37 and the pan roller gear 44 to transmit a rotational force of the intermediate gear 37 to the pan roller 41. The gears 45 and 46 are mounted on a gear shaft 48 supported by a bearing 47 which is mounted on the frame 22. The pan roller 41 rotates in a direction indicated by arrow B (FIG. 3). L-shaped roller arms 49 and 50 (the shape of the roller arm 49 is illustrated in FIG. 3 in detail) are movably mounted between the collar of the pan roller 41 and the bearing 40 and between the collar of the gear shaft 38 and the bearing 39 through thrust bearings, respectively. Inverted T-shaped arms 51 (the shape thereof is illustrated in FIG. 3 in detail) are pivotally mounted through pins 52 on corresponding free ends of the L-shaped roller arms 49 and 50, respectively. A bearing 53 is pivotally mounted on the free end of each of the T-shaped arms 51 such that the axis of the bearing 53 is deviated by a distance t3 (FIGS. 3 and 5) with respect to the shaft of a metering roller 54 having an elastic surface. Therefore, the roller 54 is supported by the bearings 53 and is brought in contact with the pan roller 41. A gear 55 mounted on the end portion of the shaft of the roller 54 is meshed with the pan roller gear 44, so that the roller 54 is rotated in the direction indicated by arrow C (FIG. 3). Bolts are loosened to pivot the bearings 53 so as to adjust a nip pressure acting on the pan roller 41.

One of the roller arms 49 is coupled to the corresponding T-shaped arm 51 through a lever 56 having an eccentric portion indicated by a distance t4 (FIGS. 3 and 5). A pin 57 of the eccentric portion is manually pivoted to throw on/off the metering roller 54 with respect to the pan roller 41. Reference numeral 58 denotes cams each having a large diameter portion 58*a* (FIG. 3) and a small diameter portion 58*b* (FIG. 3). The cams 58 are mounted on end portions of a cam shaft 59 mounted across the right and left frames 22. These end portions are adjacent to the inner surface portions of the right and left frames 22, respectively. Rollers 60 eccentrically (indicated by a distance t5) mounted on the free ends of the T-shaped arms 51 are in contact with the cam surfaces of the cams 58, respectively. Pivotal spring shafts 62 are mounted on studs 61 extending inward from the frames 22. One end of each of pivotal spring shafts 62 is pivotally mounted on the corresponding T-shaped arm 51. The T-shaped arms 51 urge the rollers 60 which tend to abut against the cams 58 by means of compression coil springs 63 mounted on the spring shafts 62, respectively. A piston rod 66 of an air cylinder 65 having an end mounted on the corresponding frame is pivotally coupled to the free end portion of a lever 64 fixed on the end of the cam shaft 59. When the piston rod 66 is moved to pivot the cams 58, the metering roller 54 can be brought into contact with or separated from the pan roller 41 through the rollers 60 and the T-shaped arms 51.

Figure 6:
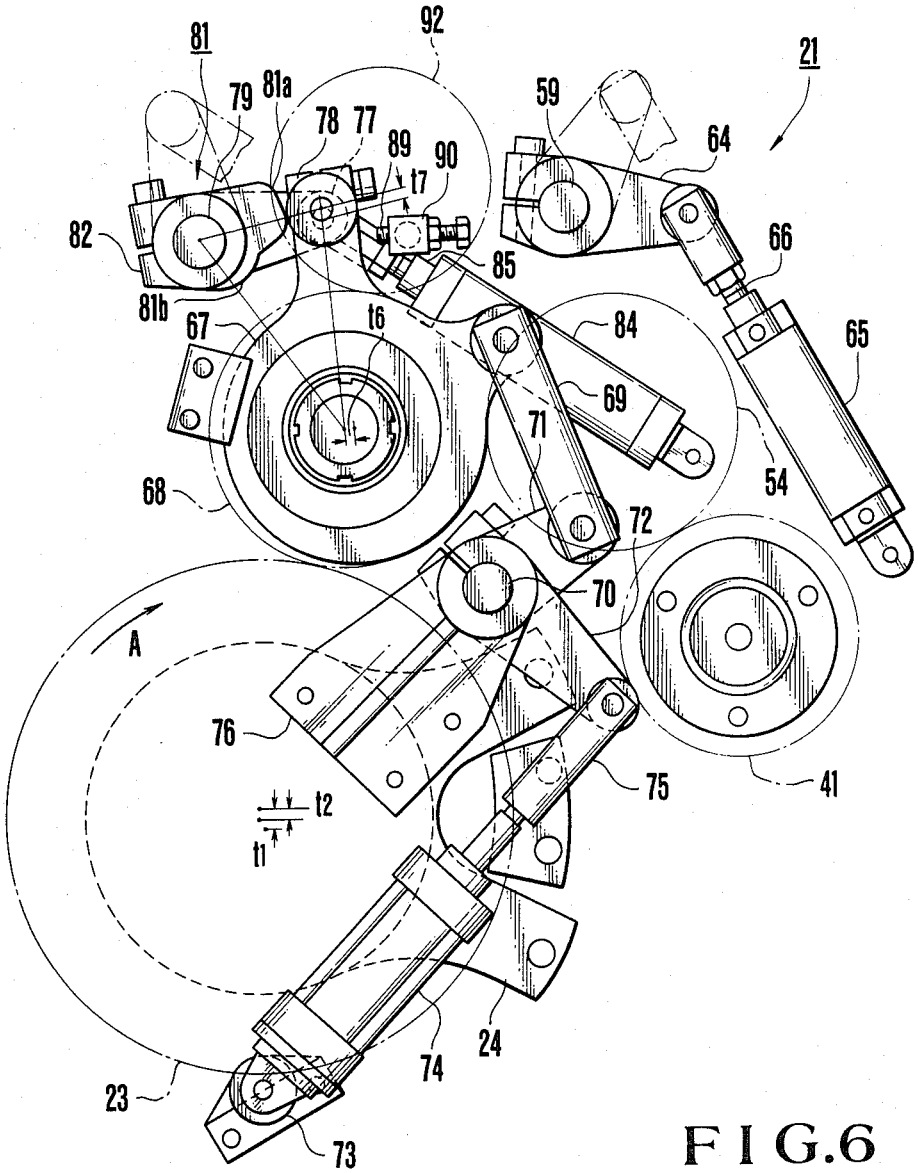
FIG. 6 is a side view of a throw-on and -off mechanism for rollers in correspondence with the portion shown in FIG. 3 when viewed from the outside of the frame.

Referring again to FIGS. 3 and 4, eccentric bearings 67 (indicated by a distance t6 in FIG. 3) are respectively mounted on the frames 22 above the blanket cylinder 23. A form roller 68 is supported by the eccentric bearings 67 and is brought into contact with the blanket cylinder 23. As shown in FIG. 4, one end of a connecting lever 69 is coupled to an outwardly extended portion of one of the eccentric bearings 67, and the other end thereof is coupled to a lever 71 which is mounted on a lever shaft 70 mounted on the frame 22. An actuator end of a piston rod 75 of an air cylinder 74 pivotally coupled to the stud 73 extending outwardly from the frame 22 is coupled to a lever 72 fixed on the other end of the lever shaft 70. When the piston rod 75 of the air cylinder 74 is moved to pivot the eccentric bearings 67 through the coupling lever 69 and the like, the form roller 68 can be thrown on/off with respect to the blanket cylinder 23. Referring to FIG. 6, reference numeral 76 denotes a bearing fixed on the bracket at the side of the frame 22 to support the lever shaft 70 outside the frame 22. As shown in FIG. 4, the roller shafts 77 are split-clamped to be pivoted. Inner rings of rollers 78 each comprising a ball bearing are respectively fixed at the eccentric portions deviated by distances t7 with respect to the axis of the roller shaft 77. Reference numeral 79 denotes a cam shaft supported by the right and left frames 22 respectively through eccentric bearings 80. As shown in FIG. 6, the position of the cam shaft 79 is preset such that the axes of the cam shaft 79, the roller 78 and the form roller 68 correspond to apexes of a right angled triangle. Cams 81 each having a large diameter portion 81*a* and a small diameter portion 81*b* are split-clamped on the cam shaft 79. In other words, the cams 81 are respectively pivotal about the eccentric bearings 80 through the cam shaft 79. A lever 82 is split-clamped on the projecting end of the cam shaft 79, and the actuator end of a piston rod 85 of an air cylinder 84 pivotally supported by the frame 22 through a stud 83 is pivotally coupled to the free end portion of the lever 82. Bolts 86 respectively extend from the extended portions of the eccentric bearings 80 which extend inside the frames 22. The bolts 86 respectively engage with nuts such that these bolts 86 are inserted in handles 88 supported by studs 87 so as not to move axially. When the handles 88 are turned to move the bolts 86 so as to turn the eccentric bearings 80, respectively, the cams 81 are eccentrically moved together with the cam shaft 79 to shift its axis. In this throw-on and -off mechanism of the form roller 68, when the piston rod 75 (FIG. 5) of the air cylinder 74 is shortened (i.e., when the eccentric bearings 67 are pivoted clockwise in FIG. 6), the form roller 68 is separated from the blanket cylinder 23. In this case, the eccentric direction of the bearings 67 is preset such that the form roller 68 is separated from the blanket cylinder 23 while the distance between the form roller 68 and the metering roller 54 is kept to be substantially constant. In the state shown in FIG. 6, the blanket cylinder 23 is in contact with the form roller 68. In this case, the piston rod of the air cylinder 84 is shortened, and the large diameter portion 81*a* of each cam 81 is in contact with the corresponding roller 78. The roller 78 is biased by an air pressure of the air cylinder 74 to abut against the corresponding cam 81. Furthermore, when the blanket cylinder 23 is removed and the form roller 68 is thrown on the blanket cylinder 23, the piston rod 85 of the air cylinder 84 is elongated to pivot the cams 81 counterclockwise. As a result, the rollers 78 are respectively brought into contact with the small diameter portions 81*b* of the cams 81 by means of the biasing force of the air cylinder 74. Therefore, the form roller 68 is held in a state wherein it contacts the blanket cylinder 23. In other words, in the throw-on and -off positions of the blanket cylinder 23, the contact forces of the form roller 68 with respect to the blanket cylinder 23 are limited by the large diameter portions 81*a* and the small diameter portions 81*b* of the cams 81. Adjustment of these contact forces is effected by the movement of the cam 81 caused by the turning of the handle 88. Referring to FIG. 4, reference numeral 89 denote off-position stoppers which are screwed in studs 90 on the frames 22, respectively. When the blanket cylinder 23 is located in the throw-on position, the piston rod 75 of the air cylinder 74 is shortened, and the eccentric bearings 67 are respectively pivoted until they abut against the stoppers 89. Therefore, the throw-off position of the form roller 68 can be defined with respect to the throw-on position of the blanket cylinder 23. Referring to FIG. 4, reference numeral 91 denotes stoppers for defining the eccentric pivotal movement of the cams 81 when the lever 82 respectively abuts against the stoppers 91. As shown in FIG. 3, a rider roller 92 is supported at each end thereof by an arm 94 pivotal about a pin 93 on the side of the frame 22 and is brought in tight contact with the form roller 68. The arm 94 swings upon pivotal movement of a cam 95 by means of a handle (not shown), so that the rider roller 92 can be thrown on/off with respect to the form roller 68.

A drive mechanism of the motor 30, the cylinder gear 26 and the form roller 68 will be described.

One end of a clutch shaft 98 is supported by a bearing 96 fixed on the frame 22 in the vicinity of the motor 30, and the other end thereof is supported by a bracket 97 extending from the frame 22. A gear 99 is fixed on the clutch shaft 98 and is meshed with the driving gear 36 to transmit rotation of the motor 30 to the clutch shaft 98. A clutch gear 101 fixed on a one-way clutch 100 (to be described in detail later) on the clutch shaft 98 is meshed with a form roller gear 102 fixed in the end portion of the roller shaft of the form roller 68. The one-way clutch 100 has a known structure capable of transmitting a rotational force in only one direction. In this embodiment, the form roller 68 is a driven member, so that the rotational force of the motor 30 is transmitted only to the form roller 68. A one-way clutch 103 having the same construction as the one-way clutch 100 is arranged in an end portion of a roller shaft of the form roller 68. A clutch gear 104 coupled to the one-way clutch 103 is meshed with the cylinder gear 26 of the blanket cylinder 23. In this case, the form roller 68 is the driven member for the one-way clutch 103, so that the rotational force of the blanket cylinder 23 is transmitted only to the form roller 68. In this manner, the form roller 68 is selectively driven by the motor 30 and the blanket cylinder 23 through the one-way clutches 100 and 103; the form roller 68 does not simultaneously receive the rotational forces through the one-way clutches 100 and 103. Either of the one-way clutches 100 and 103 which transmits a higher rotational speed is coupled to the form roller 68, and the other one of the one-way clutches 100 and 103 which transmits a lower rotational speed is decoupled from the form roller 68.

The operation of the varnish coater 21 having the arrangement described above will now be described. The motor 30 of the varnish coater 21 is started to perform the coating operation while the blanket cylinder is located at the throw-off position. The cams 58 are pivoted by the air cylinder 65 to abut the rollers 60 against the small diameter portions 58*b* of the cams 58, respectively, so that the metering roller 54 is brought into tight contact with the pan roller 41 and the form roller 68 by means of the biasing forces of the compression coil springs 63. In this case, the piston rod 75 of the air cylinder 74 is elongated so that the rollers 78 of the eccentric bearings 67 are respectively brought into tight contact with the large diameter portions 81*a* of the cams 81. The form roller 68 is located in the throw-on position. However, since the blanket cylinder 23 is located in the throw-off position, the form roller 68 is separated from the blanket cylinder 23. In this case, the rotation of the motor 30 is transmitted to the pan roller 41 and the metering roller 54 through the bevel gear in the gear box 32, and the gears 36, 37, 45, 46, 44 and 55. The rotation of the motor 30 is also transmitted to the form roller 68 through the gears 36 and 99, the one-way clutch 100 and the gears 101 and 102. The blanket cylinder 23 is separated from the impression cylinder 11, and these cylinders are stopped. Upon rotation of the above-mentioned rollers, the varnish 43 is drawn by the pan roller 41 from the varnish pan 42. A thickness of the varnish film is adjusted upon contact between the pan roller 41 and the metering roller 54. The varnish film having a predetermined thickness is transferred to the form roller 68. Varnish circulates through the pan roller 41, the metering roller 54 and the form roller 68. When the rotary printing press is started to feed a sheet 13 onto the feedboard 14 by means of the automatic feeder 2, the blanket cylinders 8 of the printing units 3 are located in the throw-on positions, so that the sheet 13 is subjected to four-color process printing through the blanket cylinders and the corresponding impression cylinders 9. The printed sheet is fed toward the coating unit 4. When the printed sheet reaches the coating unit 4, the plain bearings 25 are pivoted in response to the command from a timing controller, so that the blanket cylinder 23 is located in the throw-on position, and that the blanket cylinder 23 is brought into tight contact with the impression cylinder 11 and the form roller 68. Varnish circulating between the form roller 68 and the pan roller 41 is transferred to the blanket cylinder 23 and is applied to the printed sheet passing between the blanket cylinder 23 and the impression cylinder 11. The coated sheet 13 is fed by the delivery chains 19 and is stacked on the stack board 20. In the throw-on position of the blanket cylinder 23, the rotational force is transmitted from the motor 30 to the form roller 68 through the one-way clutch 100. At the same time, since the blanket cylinder 23 is located in the throw-on position, the rotational force of the blanket cylinder 23 is transmitted to the form roller 68 through the gears 26 and 104 and the one-way clutch 103. The rotational speed of the blanket cylinder 23 is higher than that of the motor 30, so that only the rotational force of the blanket cylinder 23 is transmitted to the form roller 68. The one-way clutch 100 is decoupled from the form roller 68.

The throw-on/off operation of the form roller 68 and the adjustment of the contact pressure of the form roller 68 with respect to the blanket cylinder 23 during the coating operation will be described.

During the coating operation as previously described, the blanket cylinder 23 is located in the throw-on position with respect to the impression cylinder 11 and the form roller 68. In other words, the blanket cylinder 23 is brought into tight contact with the impression cylinder 11 and the form roller 68. In this case, the rollers 78 are respectively in contact with the large diameter portions 81*a* of the cams 81. The piston rod 75 of the air cylinder 74 is biased in a direction toward which the piston rod 75 is elongated by the air pressure. The rollers 78 are in tight contact with the large diameter portions 81*a* of the cams 81, so that the pivotal movement of the eccentric bearings 67 are defined by the tight contact between the rollers 78 and the corresponding large diameter portions 81*a*. As previously described, when the blanket of the blanket cylinder 23 is partially deformed and the thickness of the varnish film becomes nonuniform, the rotary printing press is stopped to eliminate irregular thickness of the underlay. In this case, the blanket cylinders 8 of the printing units 3 are located in the throw-off positions. At the same time, the blanket cylinder 23 of the varnish coater 21 is also located in the throw-off position with respect to the impression cylinder 11 and the form roller 68. Even if the blanket cylinder 23 is located in the throw-off position, the gear 26 continues to mesh with the the gear 104. The form roller 68 continues to be driven by the blanket cylinder 23 through the one-way clutch 103. At the same time, the pan roller 41 and the metering roller 54 continues to be driven by the motor 30, so that the varnish circulates between the varnish pan 42 and the form roller 68 and will not be hardened. The rollers 78 are held in contact with the large diameter portions 81*a* of the cams 81, respectively, so that the form roller 68 is separated from the blanket cylinder 23. After the blanket cylinder 23 is cleaned, the underlay of the blanket is adjusted to eliminate the nonuniform thickness of the underlay. After the adjustment is completed, the air cylinder 84 is actuated to elongate the piston rod 85. When the cams 81 are pivoted counterclockwise (FIG.

6) through about 90°, the rollers 78 are pivoted until they are respectively brought into tight contact with the small diameter portions 81*b* of the cams 81 since the eccentric bearings 67 are biased by the air cylinder 74. Therefore, the form roller 68 is brought into contact with the blanket cylinder 23 which is located in the throw-off position, so that the varnish in circulation is transferred from the form roller 68 to the blanket cylinder 23. In this condition, the operator can visually observe and check varnish coating from the form roller 68 to the blanket cylinder 23, thereby checking the result of underlay adjustment. When the printing operation is then restarted, the air cylinders 74 and 84 are actuated in response to predetermined time signals from the timing controller. The rollers 78 are brought into tight contact with the large diameter portions 81*a* of the cams 81 and the blanket cylinder 23 is located in the throw-on position. Therefore, the form roller 68 is brought into tight contact with the blanket cylinder 23 at a contact pressure preset by the cams 81 and the rollers 78.

In the coating operation performed in the manner as described above, when the blanket cylinder 23 is located in the throw-on position, the rollers 78 are respectively brought into tight contact with the large diameter portions 81*a* of the cams 81 by the air pressure of the air cylinder 74. The contact pressure of the form roller 68 with respect to the blanket cylinder 23 is defined by the tight contact between the rollers 78 and the corresponding large diameter portions 81*a*. On the other hand, when the blanket cylinder 23 is located in the throw-off position, the rollers 78 are respectively brought into tight contact with the small diameter portions 81*b* by the air pressure of the air cylinder 74. In this manner the contact pressure of the form roller 68 with respect to the blanket cylinder 23 is defined by the tight contact between the rollers 78 and the small diameter portions 81*b*. The contact pressure can be adjusted by rotating the eccentric bearings 80 mounted on the cam shaft 79 by means of handles 88. In other words, the contact pressure can be adjusted by a change in distance between the axes of the cam 81 and the corresponding roller 78. In this case, even if the position of the cam 81 is changed, the position of the large diameter portion 81*a* is not changed relative to that of the small diameter portion 81*b*. Only by changing the position of the cams 81, the contact pressures at the times when the blanket cylinder 23 is located in the throw-on and -off positions can be simultaneously adjusted. When split-clamping is released to pivot the roller shafts 77 of the rollers 78, the rollers 78 can be moved away from or closer to the axis of the roller 68. As is apparent from FIG. 6, the eccentric bearings 67 are slightly rotated, so that the difference (i.e., cam lift) between each small diameter portion 81*b* and the corresponding large diameter portion 81*b* can change. Therefore, the contact pressure at the time of throw-on operation of the blanket cylinder 23 relative to that at the time of throw-off operation thereof can be adjusted. In this case, if at least one of the large diameter portion 81*a* and the small diameter portion 81*b* comprises a concentric arc but has a slope along the circumferential direction, the cam lift can be easily changed. The zero contact pressure point adjustment can be easily performed. An error in the manufacturing process can be properly absorbed, and an adjustment at the time of wear can be easily performed.

In the above embodiment, the rollers 78 are respectively brought into tight contact with the surfaces of the cams 81 by the air cylinder 74 as the biasing means. If the form roller 68 need not be located in the throw-off position with respect to the blanket cylinder 23 when the blanket cylinder 23 is located in the throw-off position, the biasing means may comprise a coil spring in place of the air cylinder.

As is apparent from the above description, in the varnish coater for the printed product according to the present invention, the blanket cylinder and the form roller are respectively supported by eccentric bearings to throw on/off the blanket cylinder with respect to the form roller and an impression cylinder and throw on/-off the form roller with respect to the blanket cylinder, and the rollers provided in the eccentric bearings of the form roller are respectively brought by biasing means into tight contact with cam surfaces of cams pivoted by pivot means so as to change with an identical magnitude contact pressures of the form roller with respect to the blanket cylinder at the throw-on and -off positions of the blanket cylinder. By changing the position of the axis of the cam, the contact pressures of the form roller with respect to the throw-on and -off positions of the blanket cylinder can be simultaneously adjusted. Therefore operability can be greatly improved as compared with the conventional mechanism wherein the contact pressures are adjusted by the turnbuckle and the like, thereby improving the operation efficiency and decreasing labor. In addition to these advantage, since the form roller is brought into tight contact with or is separated from the blanket cylinder upon pivotal movement of the eccentric bearings, the impact caused by the contact between the form roller and the blanket cylinder is decreased, and durability of the members can be improved. In addition, the contact pressure adjustment at the time of throw-on position of the blanket cylinder will not influence that at the time of throw-off position thereof. Furthermore, the rollers can be adjusted to be away from and closer to the form roller. When the slope is formed on the cam surface along the circumferential direction of the cam, the cam lift can be changed. The error in the manufacturing process can be absorbed, and the cam lift adjustment at the time of wear of the cam surface can be easily performed.

What is claimed is:

1. A varnish coater for coating varnish transferred from a form roller to a blanket cylinder on a printed sheet passing through the blanket cylinder and an impression cylinder, comprising:

first eccentric bearings for supporting said form roller;

rolling members mounted on outer end portions of said first eccentric bearings, respectively;

cams which are pivotally supported by second eccentric bearings, respectively, and each of which has a large diameter portion and a small diameter portion which are selectively brought into contact with a corresponding one of said rolling members;

first pivoting means for pivoting said cams;

biasing means for biasing said rolling members each of which is brought into tight contact with one of said large and small diameter portions of a corresponding one of said cams; and second pivoting means for pivoting said second eccentric bearings to shift an axis of a cam shaft of said cams.

2. A varnish coater according to claim 1, wherein said first pivoting means comprises:

an air cylinder which is operated in response to a given timing signal;

a piston rod which is reciprocally inserted in said air cylinder; and a lever coupled between said piston rod and one of said cams to pivot said cams.

3. A varnish coater according to claim 1, wherein said biasing means comprises:

an air cylinder which is operated in response to a given timing signal;

a piston rod which is reciprocally inserted in said air cylinder;

a first lever one end of which is connected to said piston rod;

a second lever one end of which is connected to the other end of said first lever; and a connecting lever one end of which is connected to the other end of said second lever and the other end of which is coupled to an extended portion of one of said first eccentric bearings.

4. A varnish coater according to claim 1, wherein said second pivoting means comprises:

bolts mounted on extended portions of said second eccentric bearings, respectively;

handles coupled to said bolts through studs, respectively; and stoppers for defining a range of pivotal movement of each of said second eccentric bearings.

5. A varnish coater according to claim 1, wherein said cam shaft has an axis which constitutes a right-angled triangle together with axes of said rolling members and said form roller.

* * * * *